United States Patent [19]

Baker et al.

[11] 3,971,965

[45] July 27, 1976

[54] INTERNALLY-FOCUSED TRAVELING WAVE TUBE

[75] Inventors: Halsted W. Baker, Forked River; Arthur H. Gottfried, Rumson, both of N.J.

[73] Assignee: The United States of America as represented by the Secretary of the Army, Washington, D.C.

[22] Filed: Mar. 31, 1975

[21] Appl. No.: 563,546

[52] U.S. Cl. ..... 315/3.5; 315/3.6; 315/5.35

[51] Int. Cl.[2] ..... H01J 25/34

[58] Field of Search ..... 315/3.5, 5.34, 5.35, 315/3.6; 330/43

[56] References Cited

UNITED STATES PATENTS

| | | | |
|---|---|---|---|
| 3,324,339 | 6/1967 | Winslow et al. | 315/3.5 |
| 3,508,108 | 4/1970 | Salisbury | 315/39.3 |
| 3,610,998 | 10/1971 | Falce | 315/3.5 |
| 3,705,327 | 12/1972 | Scott | 315/5.34 |
| 3,787,747 | 1/1974 | Scott | 315/3.5 |

*Primary Examiner*—Saxfield Chatmon, Jr.
*Attorney, Agent, or Firm*—Nathan Edelberg; Sheldon Kanars; Frank Dynda

[57] ABSTRACT

An electron tube for use as a traveling-wave tube or the like comprises an elongated housing having a central evacuated passageway therethrough and a plurality of annular magnets and circuit means supported within said housing at predetermined spaced locations along the length of said passageway within said housing. Preferably, the housing comprises a pair of generally semi-cylindrical mating ceramic substrate halves, each half including semi-annular grooves along the interior thereof which mate with respective semi-annular grooves of the other half to define annular grooves in which said magnets may be positioned or formed and annular portions of said circuit means may be deposited. Preferably, the respective ceramic substrate halves also have guide paths established therein for the reception of conductive material deposited therein to form the interconnecting portions of said circuit means.

8 Claims, 6 Drawing Figures

INTERNALLY-FOCUSED TRAVELING WAVE TUBE

The invention described herein may be manufactured and used by or for the Government for governmental purposes without the payment of any royalties thereon or therefor.

FIELD OF THE INVENTION

This invention relates to electron tubes such as traveling-wave tubes and the like which employ electron beams therein, and particularly to such tubes as employ magnetic focusing for the electron beam thereof. More particularly this invention relates to such tubes wherein the magnetic structure as well as the circuitry for controlling the electron beam are confined within the evacuated structure of an elongated, traveling-wave tube.

BACKGROUND OF THE INVENTION

Electron tubes such as traveling-wave tubes (TWT's) conventionally include an evacuated housing in which a beam of electrons is focused and projected axially from a cathode to a collector through a section of a waveguide. Amplification results from interaction between the electron beam and the axial component of electrical field of a wave propagated through the internally provided circuit.

A conventional technique for focusing the electron beam employs periodic-permanent-magnets external to the vacuum envelope of the tube with magnetic shims utilized between the magnets to direct the magnetic focusing flux toward the electron beam and to decrease leakage flux. However, relatively large magnets and shims are required to produce the required magnetic field in the center of the traveling-wave tube and relatively complex and expensive mounting arrangements are required to support the magnets and shims externally in a predetermined fashion about the tube envelope.

Further increasing the complexity and cost of such tubes of the prior art is the requirement for prefabricating and supporting the circuit within the tube envelope.

In our co-pending application Ser. No. 497,787, filed 15 Aug. 1974, for "A Low-Cost Periodic Permanent Magnet and Electrostatic Focusing Scheme for Electron Tubes," we teach a form of traveling-wave tube wherein the periodic-permanent magnets are positioned within the evacuated housing to reduce the size and the cost of the magnetic and electrostatic focusing and control systems for such tubes.

In this co-pending application, a ceramic substrate is shown that includes separate slots for each of the magnets as well as separate slots for the electrical control circuitry. This aspect of the invention provides that the focusing magnets are located inside the vacuum tube envelope and, therefore, closer to the beam. In this co-pending invention, beam focusing is achieved without the necessity of magnetic shims and mounting brackets and the overall supporting arrangement for the permanent magnets is materially simplified. However, the interspacing of the magnets and the control circuit element requires more space between the electrical elements and a more complex ceramic substrate than that of the subject invention.

SUMMARY OF THE INVENTION

The subject invention provides an electron tube for use, for example, in a traveling-wave tube which comprises an elongated housing having a central evacuated passageway therethrough, circuit means supported within the housing, and a plurality of annular magnets supported within the housing at predetermined spaced locations along the length of the passageway. The circuit means include annular portions at intervals along the central, evacuated passageway. However, in the subject invention, the annular magnets coincide with, and may be contained in the same annular grooves or recesses as the annular portions of the circuit means. The magnets may be positioned in these annular grooves — or sputtered or sprayed as magnetic material therein — to reduce the overall size and complexity of a traveling-wave tube, and to reduce the cost, weight and other disadvantages of the prior art tubes.

As in the aforementioned co-pending application, the tube housing may comprise a pair of generally semi-cylindrical mating ceramic substrate halves, each half including semi-annular grooves along the interior thereof which mate with respective semi-annular grooves on the other half to define complete annular grooves which receive and support the internally located magnets as well as the annular portions of the circuit conductors when the pair of mating substrate halves are jointed to one another. Semiannular prefabricated ring magnets may be positioned in the semiannular grooves or, appropriate magnetic material may be sputtered or sprayed into the semi-annular grooves in the presence of a suitable magnetizing field to form the magnets. In either embodiment, protective coatings may be employed to shield the magnets from the vacuum environment.

The aforementioned casing halves may also be provided with circuit guide paths, interconnecting the annular portions of the circuit, into which conductive material may be deposited such that the interconnecting portions of the internal circuitry are economically formed.

Accordingly, it is an object of the instant invention to provide an electron tube for use in traveling-wave tubes and the like in which the focusing magnets are located inside the vacuum envelope and, therefore, closer to the beam.

Another object of the instant invention is to provide such atubeinwhich the tube housing is formed of a pair of generally mating ceramic substrate halves, each half including semi-annular grooves or supports which cooperate to receive and support internally located permanent magnets as well as electrical conductors.

Still another object of the instant invention is to provide such a tube in which the semi-cylindrical halves of the housing are provided with additional circuit paths in which conductive material may be deposited to complete the internal circuitry of the tube.

These and other objects of the instant invention will be apparent by referring to the following specification and drawings.

DETAILED DESCRIPTION

Figure 1:
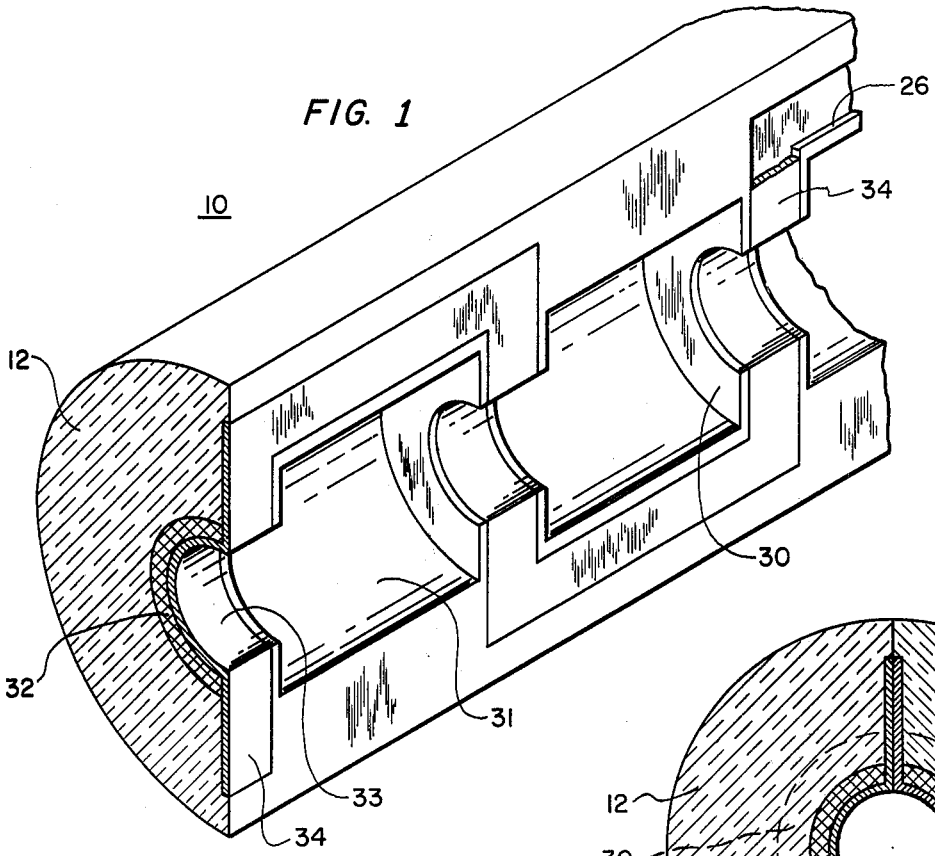
FIG. 1 is a perspective view, partially in section, of one of the two mating halves of ceramic substrate for a tube constructed in accordance with the instant invention.
Figure 3:
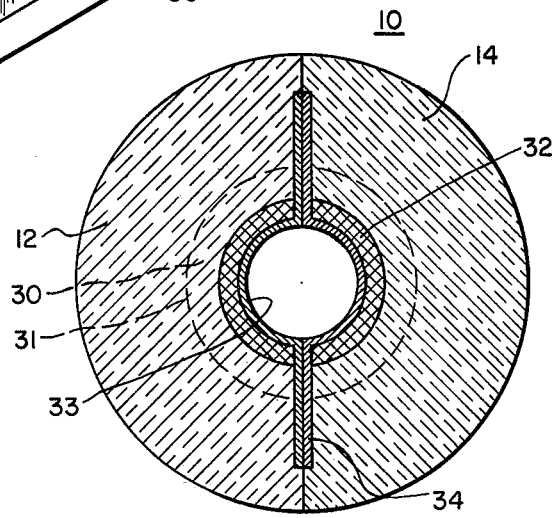
FIG. 3 is a sectional view of the substrate of FIG. 2 taken along the line 3—3.
Figure 2:
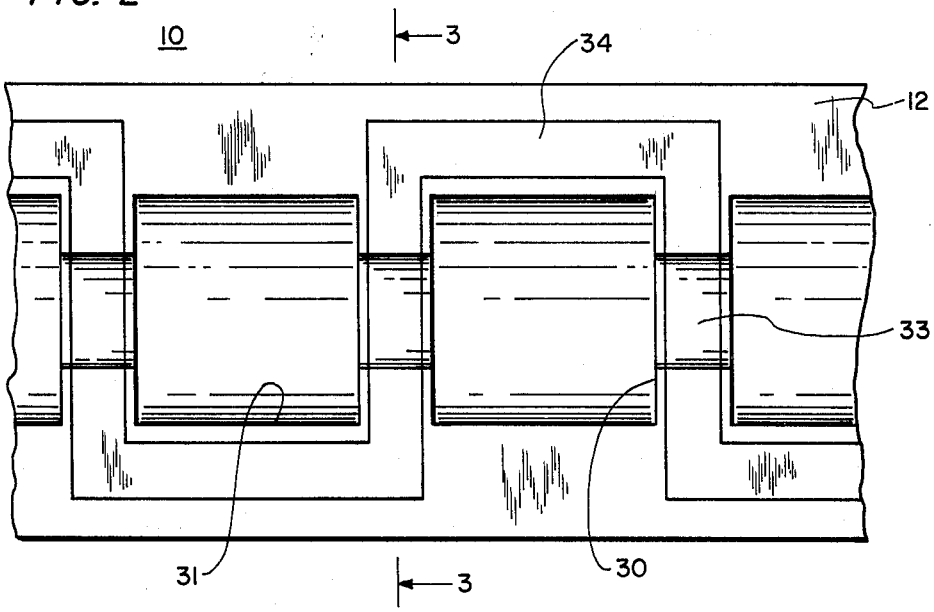
FIG. 2 is a plan view of the one half of the substrate and circuits of FIG. 1.

Turning to the figures wherein like numerals are used to designate like elements, there is shown in the drawings a section 10 of the internal portion of a traveling-wave tube constructed in accordance with the invention, it being understood that such conventional elements as the cathode and collector, positioned at opposite ends of the tube, etc., have been eliminated for the sake of drawing simplicity. The internal portion of the tube 10 comprises a housing consisting of two generally semi-cylindrical mating ceramic substrate halves 12 and 14 which, when joined, as by brazing, define a central passageway along the central axis of the tube, through which an electron beam passes after the passageway has been appropriately evacuated and the tube electrodes energized.

The central passageway may include a series of upstanding ribs or projections 30 projecting inwardly from an inner wall 31 and spaced at uniform intervals along the central passageway. These projections define a series of spaced rings on which magnets 32 can be mounted or deposited and conductive material 33 deposited.

The magnets 32 are limited to these locations but the conductive material 33–34 also continues along recesses 26 that provide a guide path for the electrical circuitry of the tubes.

If larger, preformed magnets are used they may take the place of the projections 30, and, mounted in opposing halves along the central passageway, may also include recesses wherein the conductive material 33 can be deposited.

Figure 4:
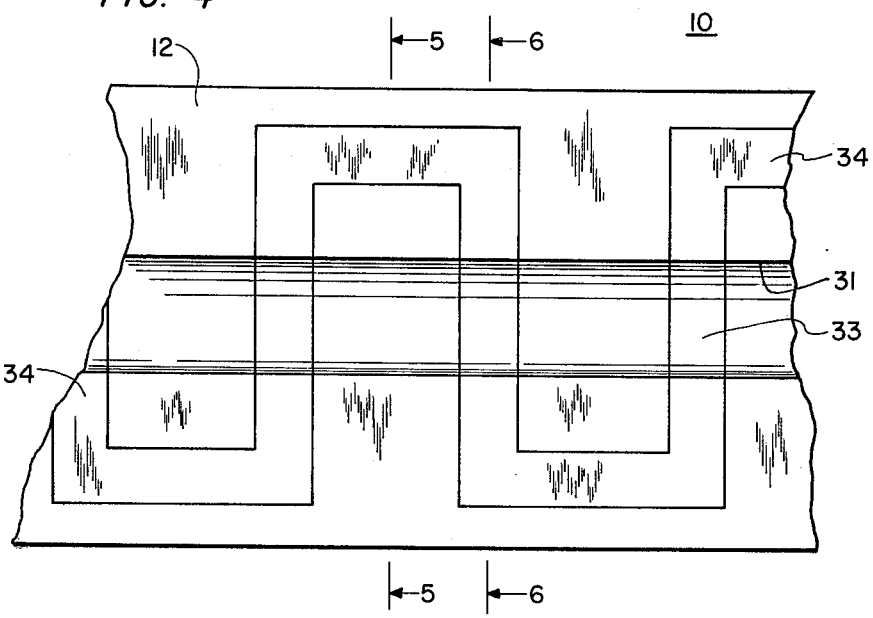
FIG. 4 is a plan view of one half of the substrate of another specie of this invention.
Figure 5:
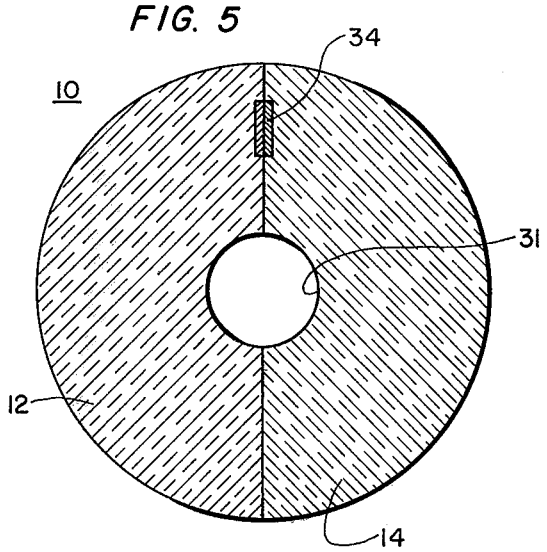
FIG. 5 is a cross-sectional view of the substrate of FIG. 4 taken along the lines 5—5.
Figure 6:
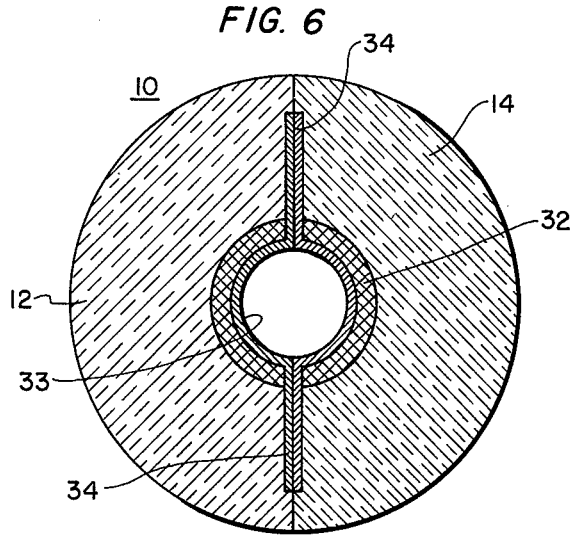
FIG. 6 is a cross-sectional view of the substrate of FIG. 4 taken along the lines 6—6.

Alternatively, the magnets or magnetic material 32, as well as the conductive material 33, may be recessed into the inner surface 31 of the central passageway as seen in the species of FIGS. 4–6. This may have structural, or constructional advantages, although electrical losses may be higher.

The periodic-permanent-magnet rings 32 are formed of suitable magnetic material such as samarium-cobalt. The rings 32 focus the electron beam passing through the center of the tube from the cathode at one end to the collector at the other end. These elements are well known in the art, but are not shown here.

Preferably, the magnets 32 are covered with a protective coating to shield them from the vacuum environment. Such coating may comprise a nonconductive material such as aluminum oxide which has been sprayed onto all sides of the magnets before it is put into the substrate.

If a protective coating is employed with deposited magnetic material, the recesses for the magnets may be sprayed with the protective material before the magnetic material 32 is deposited, and then the exposed faces of the magnetic material may be sprayed once again with the protective coating before the conductive material 33–34 is deposited on the inner surfaces of the magnets, and in the circuit guide paths 26, and the halves 12 and 14 are joined.

Alternatively, the magnets 32 may also be protectively coated with conductive material such as tungsten, copper, or molybdenum to function electrically with the adjoining circuitry.

As also seen from the drawings, and noted earlier, the mating halves of the housing may be provided with circuit guide paths, in the form of recesses 26, as well as recesses in the upstanding ribs 30, into which the conductive material 33–34 may be deposited to form a circuit having the desired configuration appropriate for a particular tube. Although the casting halves 12 and 14 may be machined, it is preferred that they be manufactured by a casting technique.

While the preferrred embodiment illustrated here shows the conductive material for the circuit guide paths inside of the magnetic material — which necessitates breaks in the magnetic structure, it may be desirable, in some cases, to apply the conductive material first, directly on the substrate, or in suitable recesses, and to position the magnets within the conductive rings. The magnets, again, should have a protective coating which may be conductive.

As noted earlier, the magnets in this invention may be preformed but are preferably formed by depositing or spraying magnetic material into the annular grooves or recesses in the presence of a magnetic field. Since the magnetic fields of the adjacent annular magnets must be opposing to produce the necessary focusing field, alternate magnets can be deposited in the presence of a field of one polarity and the others in the reverse polarity. Preformed magnets must, of course, be mounted in a corresponding manner.

Although the invention has been described with respect to a cylindrical tube, it will be appreciated that it may be practiced in other configurations such as rectangular, oval or the like.

WHAT IS CLAIMED IS:

1. In a traveling-wave type electron tube the improvement comprising:

an elongated housing having a central evacuated passageway therethrough;

a plurality of annular magnets, concentric with said central evacuated passageway, supported within said housing at predetermined spaced locations along the length of said passageway; and circuit means supported within said housing having annular portions concentric with and coincident with said magnets.

2. The tube of claim 1 wherein said housing includes grooves on the interior thereof for receiving and supporting said magnets and said annular portions of said circuit means.

3. The tube of claim 2 wherein said housing includes a circuit guide path established along the interior thereof; and another portion of said circuit means being deposited in said circuit guide path.

4. The tube of claim 3 wherein said housing comprises a pair of generaly semi-cylindrical mating ceramic substrate halves, each half including semi-annular grooves along the interior thereof which mate with respective semi-annular grooves of the other half to define said grooves which receive and support said magnets and said annular portions of said circuit means.

5. The tube of claim 1 wherein said magnets are provided with a protective coating thereon.

6. The tube of claim 5 wherein said protective coating is electrically conductive.

7. The tube of claim 1 wherein each of said annular magnets is in the same plane with and positioned outside of a corresponding one of said annular portions of said circuit means.

8. The tube of claim 1 wherein each of said annular magnets is in the same plane with and positioned inside of a corresponding one of said annular portions of said circuit means.

* * * * *